US005159878A

United States Patent [19]

Donelan et al.

[11] Patent Number: 5,159,878

[45] Date of Patent: Nov. 3, 1992

[54] SYSTEM FOR MOVING A PLATE CYLINDER RELATIVE TO A BLANKET CYLINDER

[75] Inventors: Michael E. Donelan, Portsmouth; Joel C. Hern, Rollinsford, both of N.H.

[73] Assignee: Heidelberg Harris, Inc., Dover, N.H.

[21] Appl. No.: 860,144

[22] Filed: Mar. 30, 1992

[51] Int. Cl.[5] ..... B41F 7/04; B41F 13/14

[52] U.S. Cl. ..... 101/217; 101/248

[58] Field of Search ..... 101/248, 181, 177, 176, 101/137, 142, 220, 217, 492, 486, 485, 216, 219, 218, 174

[56] References Cited

U.S. PATENT DOCUMENTS 3,717,092 2/1973 Crum .

4,137,845 2/1979 Jeschke ..... 101/248

4,953,461 9/1990 Gaffney et al. .

*Primary Examiner*—J. Reed Fisher

*Attorney, Agent, or Firm*—Tarolli, Sundheim & Covell

[57] ABSTRACT

An offset lithographic printing unit (10) in a multi-unit printing press (35) includes a first register adjusting mechanism (80) and a second register adjusting mechanism (84). The first register adjusting mechanism (80) changes the surface speed of the plate cylinder (12) relative to the surface speed of the blanket cylinder (14) when the cylinders (12, 14) are being rotated in a printing operation. The second register adjusting mechanism (84) moves the plate cylinder (12) axially relative to the blanket cylinder (14) when the cylinders (12, 14) are being rotated in a printing operation. A controller (300) operates the first and second register adjusting mechanisms (80, 84) simultaneously when the cylinders (12, 14) are being rotated in a printing operation.

4 Claims, 3 Drawing Sheets

SYSTEM FOR MOVING A PLATE CYLINDER RELATIVE TO A BLANKET CYLINDER

FIELD OF THE INVENTION

The present invention relates to a printing unit having a rotatable plate cylinder and a rotatable blanket cylinder, and particularly relates to a system for changing the position of the plate cylinder relative to the position of the blanket cylinder.

BACKGROUND OF THE INVENTION

U.S. Pat. No. 4,137,845 discloses a printing unit in a multi-unit printing press. The printing unit includes a plate cylinder carrying a printing plate upon which an inked image is defined, and a blanket cylinder carrying a printing blanket which transfers the inked image from the printing plate to material being printed. The printing press includes a mechanism for adjusting the plate cylinder circumferentially, and also includes a mechanism for adjusting the plate cylinder axially. The mechanisms enable the circumferential and axial adjustments to be made independently of each other during the making ready of the printing press before printing is performed. The adjustments are made at the printing unit during the making ready of the multi-unit press so that the image printed by the printing unit will have precise registration with another image that is printed in an adjacent printing unit in the multi-unit press.

U.S. Pat. No. 4,953,461 discloses a printing unit having a mechanism for adjusting the position of the plate cylinder relative to the blanket cylinder during a printing operation, i.e., after the register settings have been made during the making ready of the multi-unit printing press. When the plate cylinder and the blanket cylinder are being rotated to transfer the inked image to the printed material, the mechanism disclosed in the '461 patent further rotates the plate cylinder relative to the blanket cylinder to change the surface speed of the printing plate relative to the surface speed of the printing blanket. The surface of the printing plate and the surface of the printing blanket therefore slide relative to each other in the circumferential direction during printing. The sliding movement of the two surfaces relative to each other reduces the amount of ink which tends to build up on the surface of the printing blanket.

SUMMARY OF THE INVENTION

In accordance with the present invention, a printing unit for printing an inked image on sheet material comprises a rotatable plate cylinder, a rotatable blanket cylinder and a frame. The plate cylinder carries a printing plate which defines the inked image. The blanket cylinder carries a printing blanket. The frame supports the plate cylinder and the blanket cylinder in positions for the printing blanket to transfer the inked image from the printing plate to the sheet material when the plate cylinder and the blanket cylinder are rotating.

The printing unit further includes a motor and a gear train for rotating the plate cylinder and the blanket cylinder to print the inked image onto the sheet material. A first register adjusting mechanism changes the surface speed of the plate cylinder relative to the surface speed of the blanket cylinder when the cylinders are being rotated by the motor and the gear train during a printing operation. A second register adjusting mechanism moves the plate cylinder axially relative to the blanket cylinder when the cylinders are being rotated by the motor and the gear train during a printing operation. Additionally, a controller operates the first and second register adjusting mechanisms simultaneously and continuously throughout repeated revolutions of the plate cylinder and the blanket cylinder when the cylinders are being rotated by the motor and the gear train during a printing operation.

A printing unit constructed in accordance with the present invention minimizes the amount of excess ink which tends to build up on the printing blanket at the locations where ink is repetitively applied to the printing blanket by the printing plate. The printing unit minimizes such build up of excess ink because the location where the printing plate applies the inked image to the printing blanket is continuously changed during the printing operation. That location on the printing blanket is continuously changed as the plate cylinder is continuously shifted both circumferentially and axially relative to the blanket cylinder. The location where the inked image is applied to the printing blanket is moved about a circular path and is thus moved over a greater distance than if it were moved only circumferentially or only axially. Excess ink applied to the printing blanket at one location on the printing blanket can therefore fade away before excess ink is again applied at the same location.

BRIEF DESCRIPTION OF THE DRAWINGS

The foregoing and other features of the present invention will become apparent to one skilled in the art upon a consideration of the following description of the invention with reference to the accompanying drawings, wherein.

DESCRIPTION OF A PREFERRED EMBODIMENT

Figure 1:
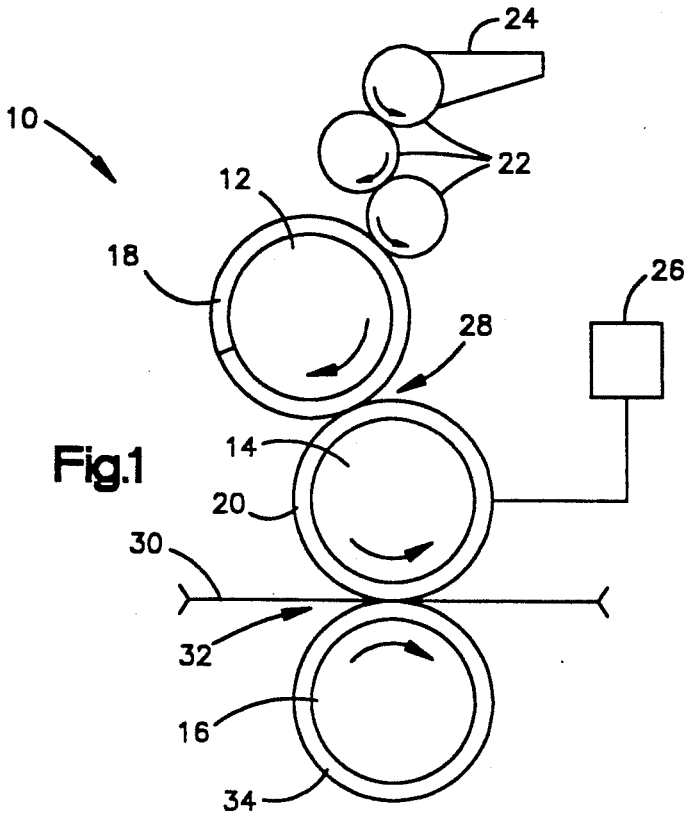
FIG. 1 is a schematic view of a printing unit constructed in accordance with the present invention.

A printing unit 10 constructed in accordance with the present invention is shown schematically in FIG. 1. The printing unit 10, by way of example, is an offset lithographic printing unit including a plate cylinder 12, a blanket cylinder 14 and an impression cylinder 16. The plate cylinder 12 carries a printing plate 18 having a surface defining an image to be printed. The blanket cylinder 14 carries printing blanket 20. The printing a unit 10 also includes inker rolls 22, an ink fountain 24, and a motor 26. The motor 26 drives a gear train which is connected to the cylinders and rolls in the printing unit 10 to rotate the cylinders and rolls a indicated by the arrows shown in FIG. 1.

When the cylinders and rolls are being rotated by the motor 26 and the gear train, the inker rolls 22 transfer ink from the ink fountain 24 to the printing plate 18 on the plate cylinder 12. The printing blanket 20 on the blanket cylinder 14 picks up the inked image from the printing plate 18 at the nip 28 between the plate cylinder 12 and the blanket cylinder 14. The printing blanket 20 subsequently transfers the inked image to the material being printed, which is preferably a web 30 moving through the nip 32 between the blanket cylinder 14 and the impression cylinder 16. As shown in FIG. 1, the impression cylinder 16 is a second blanket cylinder carrying a second printing blanket 34 for printing simultaneously on the opposite side of the web 30.

Figure 7:
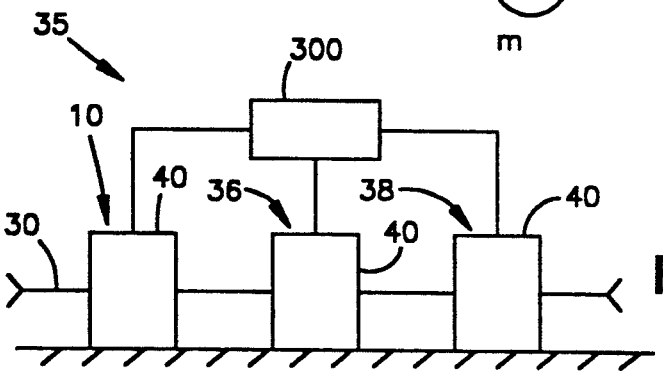
FIG. 7 is a schematic view of a multi-unit printing press constructed in accordance with the present invention.

As shown in FIG. 7, the printing unit 10 is one of a plurality of printing units in a multi-unit printing press 35. Each of the printing units 10, 36 and 38 in the multi-unit printing press 35 prints an image on the web 30 which is registered with each other image printed on the web 30 by the other printing units.

Figure 2:
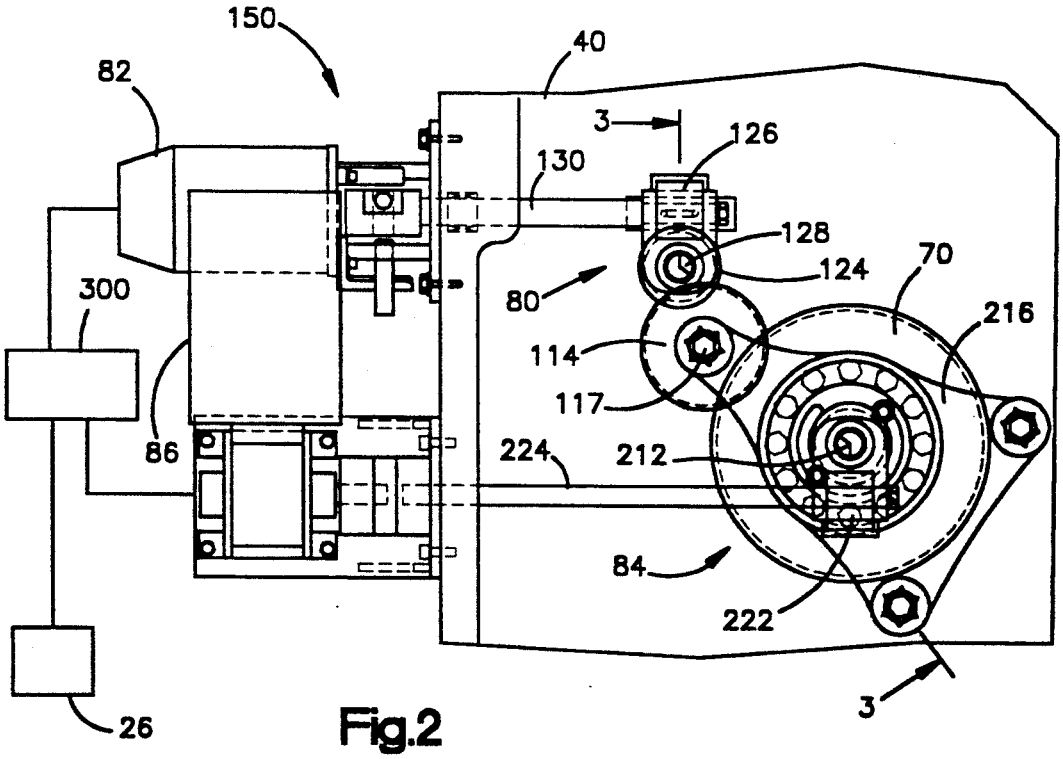
FIG. 2 is a side view of parts of a printing unit constructed in accordance with the present invention.
Figure 3:
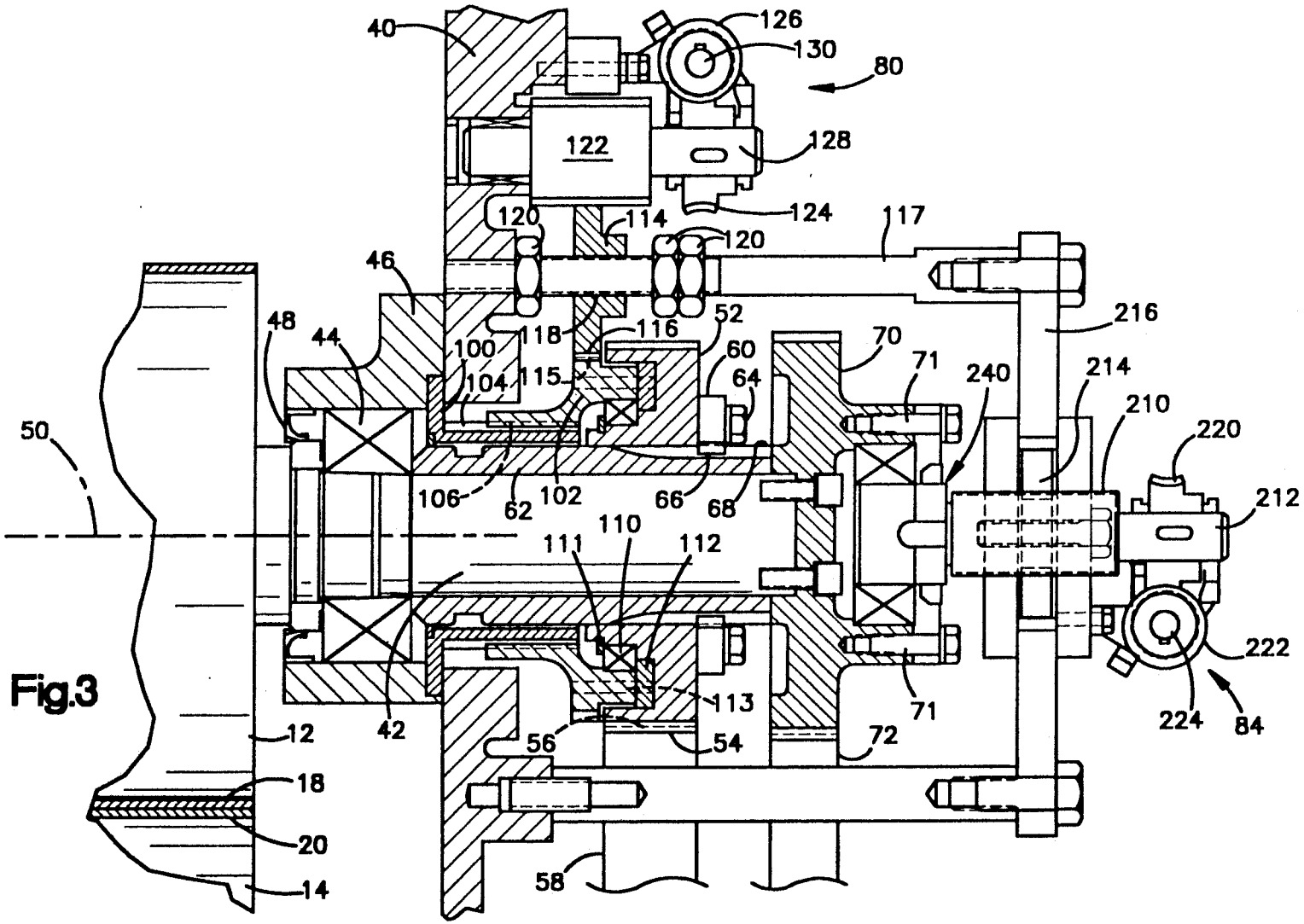
FIG. 3 is a view taken on line 3—3 of FIG. 2.

The plate cylinder 12 and the blanket cylinder 14 in the printing unit 10 are supported at their opposite ends in a pair of side frames 40, one of which is shown in FIGS. 2 and 3. Each end of the plate cylinder 12 has a stub shaft 42 extending through the adjacent side frame 40. The stub shaft 42 also extends through a roller bearing 44 which is located between the plate cylinder 12 and the side frame 40. The roller bearing 44 is contained in a bearing housing 46 which is fixed to the side frame 40. An annular seal 48 blocks the passage of dirt, ink or the like into the bearing housing 46. The plate cylinder 12 and the stub shaft 42 are thus supported by the side frame 40 and the roller bearing 44 for rotation about the plate cylinder axis 50. The blanket cylinder 14 is similarly supported by the side frame 40 and an associated roller bearing (not shown) for rotation about the blanket cylinder axis in a known manner.

The gear train which rotates the cylinders and rolls in the printing unit 10 includes a plate cylinder gear 52 with helical gear teeth 54. The helical gear teeth 54 mesh with helical gear teeth 56 on an adjoining drive gear 58 in the drive train. The plate cylinder gear 52 is connected to the stub shaft 42 on the plate cylinder 12 by an internal gear 60 and a sleeve 62. The internal gear 60 is fixed to the plate cylinder gear 52 by bolts 64, and has internal gear teeth 66. The sleeve 62 is fixed to the stub shaft 42 and has external gear teeth 68. The internal gear teeth 66 on the internal gear 60 mesh with the external gear teeth 68 on the sleeve 62. The sleeve 62 and the stub shaft 42 ar thus prevented from rotating relative to the plate cylinder gear 52 and the internal gear 60. The stub shaft 42 and the plate cylinder 12 are therefore rotated with the plate cylinder gear 52 when the plate cylinder gear 52 is rotated by the drive gear 58 in the gear train.

The gear train also includes inker roll gears for rotating the inker rolls 22 (FIG. 1). One such inker roll gear 70 is fixed to the outer end of the stub shaft 42 by bolts 71 and meshes with an adjoining inker roll gear 72. The inker roll gear 70 rotates with the plate cylinder 12 under the influence of the motor 26, and drives the adjoining inker roll gear 72 to rotate the inker rolls 22 under the influence of the motor 26.

The printing unit 10 further includes parts for adjusting the plate cylinder 12 relative to the blanket cylinder 14. Those parts include a first register adjusting mechanism 80 with a first actuator 82 (FIG. 2), and a second register adjusting mechanism 84 with a second actuator 86. The first and second actuators 82 and 86 have reversible electric motors within the housings shown in the drawings.

The first register adjusting mechanism 80 is associated with the plate cylinder gear 52. As shown in FIG. 3, the internal gear teeth 66 on the internal gear 60 can slide axially relative to the external gear teeth 68 on the sleeve 62. The plate cylinder gear 52, to which the internal gear 60 is fixed, can therefore move axially relative to the sleeve 62. Because the gear teeth 54 on the plate cylinder gear 52 and the gear teeth 56 on the drive gear 58 are helical, the plate cylinder gear 52 will move circumferentially relative to the drive gear 58 when the plate cylinder gear 52 moves axially. During the making ready of the multi-unit printing press 35, such circumferential movement of the plate cylinder gear 52 relative to the drive gear 58 will change the circumferential register of the plate cylinder 12. During a printing operation, such circumferential movement of the plate cylinder gear 52 relative to the drive gear 58 will change the rotational speed of the plate cylinder gear 52 relative to the rotational speed of the drive gear 58. The rotational surface speed of the plate cylinder 12 likewise will change relative to the rotational surface speed of the blanket cylinder 14. The first register adjusting mechanism 80 and the first actuator 82 move the plate cylinder gear 52 axially to cause such changes in the register and in the rotational surface speed of the plate cylinder 12.

As shown in FIG. 3, the first register adjusting mechanism 80 includes a first ring 100 and a second ring 102. The first ring 100 is fixed to the side frame 40 and has external screw threads 104. The second ring 102 has internal screw threads 106 which are engaged with the external screw threads 104 on the first ring 100. The second ring 102 is thus supported for simultaneous rotational and axial movement relative to the first ring 100.

The second ring 102 is also connected with the plate cylinder gear 52. A roller bearing 110 is held in place axially on the plate cylinder gear 52 by a snap ring 111. The second ring 102 is rotatable on the roller bearing 110 relative to the plate cylinder gear 52, and is held in place axially relative to the roller bearing 110 and the plate cylinder gear 52 by a connecting ring 112 which is fixed to the second ring 102 by fasteners 113. The roller bearing 110, the snap ring 111 and the connecting ring 112 thus enable the second ring 102 to rotate relative to the plate cylinder gear 52, but fix the second ring 102 axially to the plate cylinder gear 52. When the second ring 102 moves both rotationally and axially relative to the first ring 100, the plate cylinder gear 52 is moved axially by the second ring 102.

The first register adjusting mechanism 80 further includes an intermediate gear 114. The intermediate gear 114 has external gear teeth 115 in meshing engagement with external gear teeth 116 on the second ring 102. The intermediate gear 114 is supported for rotation about the axis of a stationary support bar 117 which extends outward from the side frame 40. Specifically, a sleeve 118 having external screw threads is received over the support bar 117 and is held in place on the support bar 117 by a plurality of nuts 120. The intermediate gear 114 has internal screw threads which mesh with the external screw threads on the sleeve 118. The intermediate gear 114 is thus supported for simultaneous rotational and axial movement on the sleeve 118. When the intermediate gear 114 moves rotationally and axially on the sleeve 118, the second ring 102 is simultaneously moved rotationally and axially on the first ring 100 by the intermediate gear 114. The intermeshing threads at the intermediate gear 114 and the sleeve 118 have the same pitch as the intermeshing threads 104 and 106 at the first and second rings 100 and 102 so that the intermediate gear 114 and the second ring 102 move axially in equal amounts.

Other gears in the first register adjusting mechanism 80 include an axially elongated gear 122, a worm gear 124 and a worm 126. The axially elongated gear 122 is keyed to a shaft 128 which is supported for rotation in the side frame 40. The worm gear 124 also is keyed to the shaft 128, and meshes with the worm 126. The worm 126 is keyed to an adjustment control shaft 130. As shown in FIG. 1, the adjustment control shaft 130 extends from the first register adjusting mechanism 80 to the first actuator 82, and is rotated by the first actuator 82.

When the adjustment control shaft 130 is rotated by the first actuator 82, the intermeshing relationship of the worm 126, the worm gear 124 and the axially elongated gear 122 causes simultaneous rotation of the intermediate gear 114. As noted above, the intermediate gear 114 moves axially on the sleeve 118 when it rotates about the sleeve 118. The elongated gear 122 has a length sufficient to remain engaged with the intermediate gear 114 when the intermediate gear 114 moves axially on the sleeve 118.

When the intermediate gear 114 is rotated upon rotation of the adjustment control shaft 130 by the first actuator 82, it rotates the second ring 102 and thus causes axial movement of the second ring 102 and the plate cylinder gear 52. As described above, such axial movement of the plate cylinder gear 52 changes the register of the plate cylinder 12 during the making ready of the multi-unit printing press 35, and changes the rotational surface speed of the plate cylinder 12 relative to the rotational surface speed of the blanket cylinder 14 during a printing operation. Specifically, axial movement of the plate cylinder gear 52 in one direction during a printing operation will increase the speed of the plate cylinder 12 relative to the speed of the blanket cylinder 14, and axial movement of the plate cylinder gear 52 in the opposite direction will decrease the speed of the plate cylinder 12 relative to the speed of the blanket cylinder 14. The direction of axial movement of the plate cylinder gear 52 can be reversed by the first actuator 82.

Figure 4:
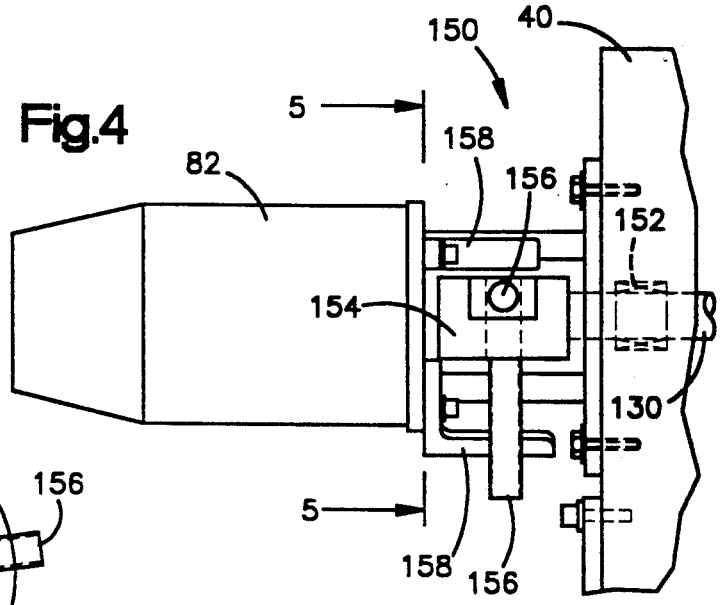
FIG. 4 is a view of parts of the printing unit shown in FIG. 2.
Figure 5:
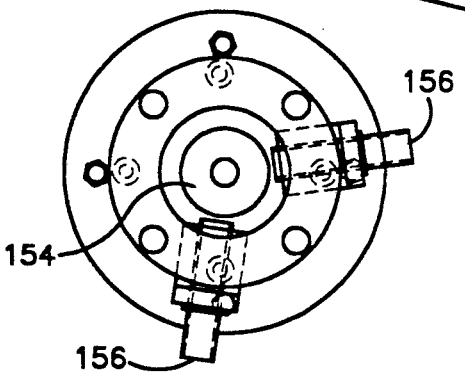
FIG. 5 is a view taken on line 5—5 of FIG. 4.

As shown in FIGS. 4 and 5, a limit mechanism 150 is associated with the first actuator 82 and the adjustment control shaft 130. The adjustment control shaft 130 extends through a roller bearing 152 which is supported on the side frame 40, and is coupled to the output shaft 154 of the first actuator 82. A pair of limit pins 156 extend radially from the output shaft 154. A pair of angles 158 extend axially from the first actuator 82. The limit pins 156 can move circumferentially within a range defined by the circumferential distance between the angles 158. The range of rotation of the output shaft 154, and of the first adjustment control shaft 130, is thus defined by the circumferential distance between the angles 158.

Referring again to FIG. 3, the second register adjusting mechanism 84 is associated with the inker roll gear 70. The second register adjusting mechanism 84 includes an externally threaded pin 210 which is fixed to a rotatable shaft 212. The pin 210 is threaded into an internally threaded ring 214 which is fixed to a stationary support member 216. The pin 210 is thus supported for simultaneous rotational and axial movement relative to the support member 216 upon rotation of the shaft 212. The shaft 212 is rotated by a worm gear 220 and a worm 222 upon rotation of a second adjustment control shaft 224 upon which the worm 222 is fixed. The second adjustment control shaft 224 extends from the second register adjusting mechanism 84 to the second actuator 86, as shown in FIG. 2, and is rotated by the second actuator 86. The pin 210 is thus supported for movement along the axis 50 under the influence of the second actuator 86.

The pin 210 is linked to the inker roll gear 70 by a roller thrust bearing 240. The roller thrust bearing 240 permits rotation of the pin 210 relative to the inker roll gear 70, and transmits axial movement of the pin 210 to the inker roll gear 70. The stub shaft 42 and the plate cylinder 12 are fixed to the inker roll gear 70 and are therefore moved axially with the inker roll gear 70 under the influence of the second actuator 86. The lateral register of the plate cylinder 12 is thus adjusted by the second register adjusting mechanism 84 and the second actuator 86. The axial direction of movement of the plate cylinder 12 can be reversed by the second actuator 86.

As shown schematically in FIG. 2, a controller 300 operates the first and second actuators 82 and 86. The controller 300 operates the first actuator 82 simultaneously with the second actuator 86 when the plate cylinder 12 and the blanket cylinder 14 ar being rotated by the motor 26 in a printing operation. The surface speed of the printing plate 18 o the plate cylinder 12 is therefore changed relative to the surface speed of the printing blanket 20 on the blanket cylinder 14 at the same time that the printing plate 18 is being moved axially relative to the printing blanket 20.

When the blanket cylinder 14 is rotating as indicated in FIG. 1, the inked image is transferred from the printing plate 18 to the moving web 30 by the printing blanket 20. If a latent dot of ink remains on the printing blanket 20 after contact with the web 30, such a latent dot of ink will be moved back to the nip 28. If the inked image on the printing plate 18 is repeatedly impressed onto the printing blanket 20 at the same location on the printing blanket 20, ink will be reapplied over such a latent dot each time the latent dot moves through the nip 28. Excess ink which could mar the printed image could then accumulate over the latent dot. However, in accordance with the present invention, the inked image on the printing plate 18 is impressed onto the printing blanket 20 at a slightly different location each time the image moves into the nip 28 because the plate cylinder 12 is continuously moved both circumferentially and axially relative to the blanket cylinder 14 throughout repeated revolutions of the plate cylinder 12 in a printing operation. Latent dots of ink formed upon successive impressions of the inked image onto the printing blanket 20 will therefore have locations that are spaced from each other, and excess ink will not be repeatedly applied at a single location. The invention thus minimizes the accumulation of excess ink on the printing blanket 20 and avoids the application of such excess ink onto the web 30.

Figure 6:
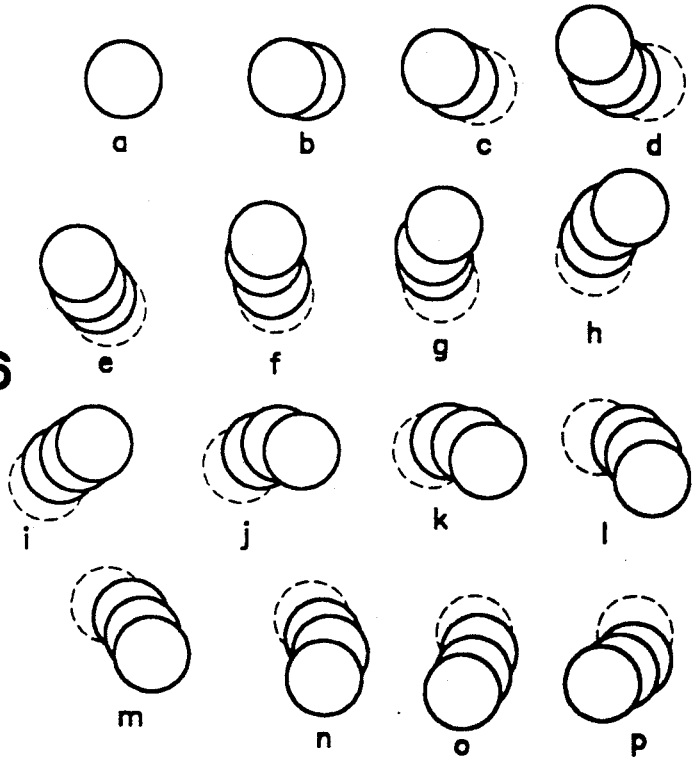
FIG. 6 is an illustration of ink dots formed in accordance with the present invention.

FIG. 6 illustrates latent dots of ink applied to the printing blanket 20 in accordance with the preferred embodiment of the invention. As described above, a latent dot of ink is applied to the printing blanket 20 upon each impression of the inked image onto the printing blanket 20 by the printing plate 18. The plurality of different illustrations designated (a)–(p) in FIG. 6 represent successive applications of a latent dot of ink onto the printing blanket 20. As the surface speed of the plate cylinder 12 changes relative to the surface speed of the blanket cylinder 14, the location of the impression made upon the printing blanket 20 by the printing plate 18 is moved circumferentially on the printing blanket 20. As the plate cylinder 12 is simultaneously moved axially relative to the blanket cylinder 14, the location of the impression is also moved axially on the printing blanket 20. Each successive latent dot of ink is thus formed on the printing blanket 20 at a location which is spaced from the next previous latent dot of ink. Preferably, the latent dots of ink are moved circumferentially on the printing blanket 20 in one direction by rotating the plate cylinder 12 at a speed greater than the speed of the blanket cylinder 14, and then the first actuator 82 is reversed to move the latent dots of ink circumferentially back in the opposite direction by rotating the plate cylinder 12 at a speed less than the speed of the blanket cylinder 14. The axial direction of movement of the latent dots of ink is reversed by reversing the second actuator 86. By periodically reversing the circumferential and axial directions of movement, the successively formed latent dots of ink are caused to traverse a circular path on the surface of the printing blanket 20, as shown in FIG. 6. The successively formed latent dots of ink thus traverse a greater distance than if they were moved only circumferentially or only axially. The first formed latent dots therefore can fade away before successive latent dots are formed again in the same location.

Most preferably, the controller 300 is responsive to the motor 26 so that the first and second actuators 82 and 86 are operated to move the impression on the printing blanket 20 at an increased rate if the press speed is increased, and to move the impression on the printing blanket 20 at a decreased rate if the press speed is decreased. The controller 300 will thereby maintain a consistent distance between successive impressions on the printing blanket 20 for all press speeds. The distance between successive impressions is small enough so that a double image is not noticeable on the printed web 30.

An additional feature of the present invention is illustrated schematically in FIG. 7. I accordance with this feature of the invention, the multi-unit printing press 35 includes other printing units 36 and 38 which are constructed like the printing unit 10. The printing units 10, 36 and 38 in the multi-unit press 35 are arranged in a row to print superimposed color images on the web 30. The controller 300 is associated with each of the printing units 10, 36 and 38 to operate the first and second actuators 82 and 86 in each of the printing units 10, 36 and 38 simultaneously and equally. Therefore, the superimposed images printed on the web 30 will remain in register with each other as the individual images impressed on each of the printing blankets 20 in the printing units 10, 36 and 38 are moved to avoid the accumulation of excess ink as described above.

From the above description of the invention, those skilled in the art will perceive improvements, changes and modifications. Such improvements, changes and modifications within the skill of the art are intended to be covered by the appended claims.

Having described the invention, the following is claimed:

1. An apparatus (10) for printing an inked image on sheet material (30), said apparatus (10) comprising:

a rotatable plate cylinder means (12) for carrying a printing plate (18) which defines the inked image;

a rotatable blanket cylinder means (14) for carrying a printing blanket (20);

frame means (40) for supporting said plate cylinder means (12) and said blanket cylinder means (14) in positions for a printing blanket (20) on said blanket cylinder means (14) to transfer the inked image from a printing plate (18) on said plate cylinder means (12) to the sheet material (30) when said plate cylinder means (12) and said blanket cylinder means (14) are rotating;

drive means (26) for rotating said plate cylinder means (12) and said blanket cylinder means (14) to transfer the inked image to the sheet material (30) in a printing operation;

first adjusting means (80, 82) for changing the surface speed of said plate cylinder means (12) relative to the surface speed of said blanket cylinder means (14) when said cylinder means (12, 14) are being rotated by said drive means (26);

second adjusting means (80, 82) for moving said plate cylinder means (12) axially relative to said blanket cylinder means (14) when said cylinder means (12, 14) are being rotated by said drive means (26); and control means (300) for operating said first and second adjusting means (80, 82) (84, 86) simultaneously and continuously to change the surface speed of said plate cylinder means (12) relative to the surface speed of said blanket cylinder means (14) and to move said plate cylinder means (12) axially relative to said blanket cylinder means (14) simultaneously and continuously throughout repeated revolutions of said plate cylinder mean (12) and said blanket cylinder means (14) when said cylinder means (12, 14) are being rotated by said drive means (26) in a printing operation.

2. An apparatus as defined in claim 1 wherein said drive means (26) includes means for rotating said plate cylinder means (12) and said blanket cylinder means (14) at an increased speed and at a decreased speed, said control means (300) being responsive to said drive means (26) to operate said first and second adjusting means (80, 82) (84, 86) at an increased rate when said drive means (26) is rotating said plate cylinder means (12) and said blanket cylinder means (14) at said increased speed, and to operate said first and second adjusting means (80, 82) (84, 86) at a decreased rate when said drive means (26) is rotating said plate cylinder means (12) and said blanket cylinder means (14) at said decreased speed.

3. An apparatus as defined in claim 1 wherein said first adjusting means (80, 82) includes a first actuator (82) and a first mechanism (80) responsive to said first actuator (82) to move said plate cylinder means (12) circumferentially relative to said blanket cylinder means (14).

4. An apparatus as defined in claim 3 wherein said second adjusting means (84, 86) includes a second actuator (86) and a second mechanism (84) responsive to said second actuator (86) to move said plate cylinder means (12) axially relative to said blanket cylinder means (14), said second actuator (86) and said second mechanism (84) being operable independently of said first actuator (82) and said first mechanism (80).

* * * * *